United States Patent [19]

Schmid et al.

[11] 4,349,066

[45] Sep. 14, 1982

[54] METHOD AND APPARATUS FOR CONTINUOUS CASTING OF A NUMBER OF STRANDS

[75] Inventors: Markus Schmid, Zürich; Hans Gloor, Umiken, both of Switzerland

[73] Assignee: Concast AG, Zürich, Switzerland

[21] Appl. No.: 138,178

[22] Filed: Apr. 7, 1980

[30] Foreign Application Priority Data

Apr. 27, 1979 [CH] Switzerland ..... 3975/79

[51] Int. Cl.[3] ..... B22D 11/16

[52] U.S. Cl. ..... 164/453; 164/413; 164/420; 164/449; 164/454

[58] Field of Search ..... 164/4, 413, 420, 449, 164/450, 453, 454

[56] References Cited

U.S. PATENT DOCUMENTS

| | | | |
|---|---|---|---|
| 2,743,492 | 5/1956 | Easton . | |
| 2,772,455 | 12/1956 | Easton et al. | 164/420 X |
| 2,948,030 | 8/1960 | Easton | 164/420 |
| 3,292,216 | 12/1966 | Colombo . | |
| 3,358,743 | 12/1967 | Adams | 164/413 X |
| 3,521,696 | 7/1970 | Lowman et al. | 164/413 X |
| 3,537,505 | 11/1970 | Thalmann et al. | 164/4 |
| 3,608,621 | 9/1971 | Bollig et al. . | |
| 3,817,311 | 6/1974 | Pellinat | 164/4 |

FOREIGN PATENT DOCUMENTS

| | | | |
|---|---|---|---|
| 1067545 | 5/1967 | United Kingdom . | |
| 538813 | 1/1977 | U.S.S.R. | 164/449 |

OTHER PUBLICATIONS

"Steel Times", Oct. 1974, pp. 645-650.

*Primary Examiner*—R. L. Spruill
*Assistant Examiner*—J. Reed Batten, Jr.
*Attorney, Agent, or Firm*—Werner W. Kleeman

[57] ABSTRACT

During the continuous casting of at least two strands, withdrawn with the same speed from the continuous casting molds, the withdrawal speed for both strands should be adjusted in accordance with the quantity of cast metal, typically steel, infed to the first continuous casting mold i.e. also the level of molten metal therein. The infed quantity of steel is regulated in at least one further continuous casting mold as a function of such withdrawal speed or velocity.

14 Claims, 3 Drawing Figures

Fig. 1
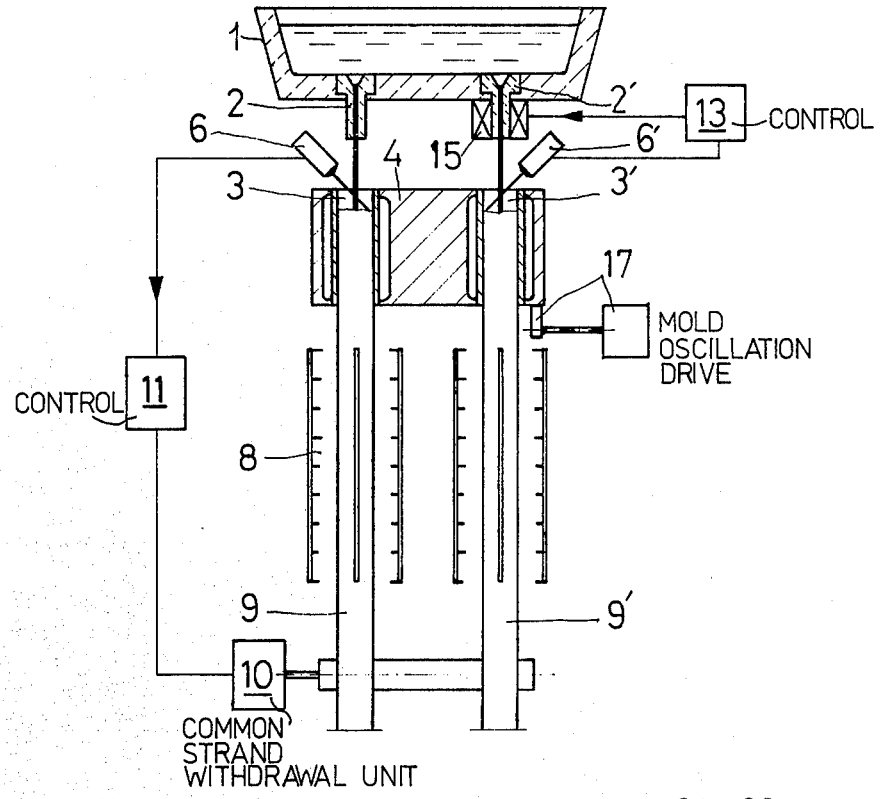
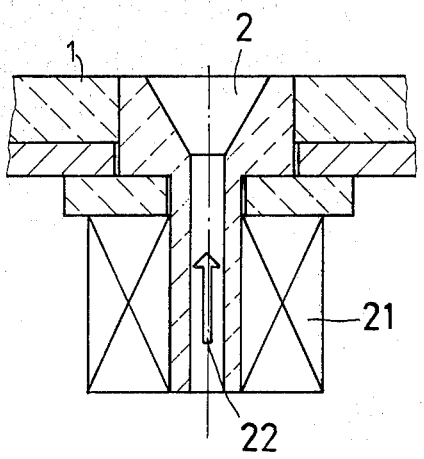
Fig. 2
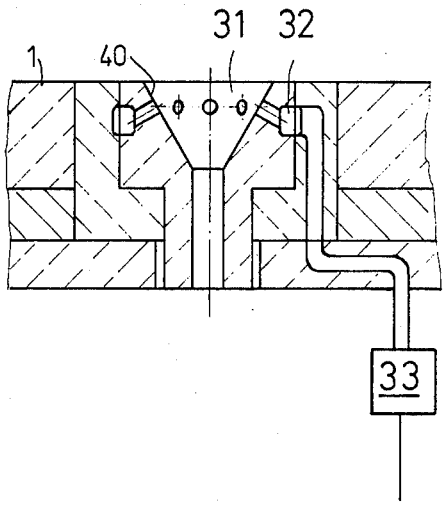
Fig. 3

METHOD AND APPARATUS FOR CONTINUOUS CASTING OF A NUMBER OF STRANDS

BACKGROUND OF THE INVENTION

The present invention relates to a new and improved method for the continuous casting of multi-strands, wherein metal is teemed, typically steel, from at least one tundish, the strands which are formed are withdrawn from the continuous casting molds with the same speed or velocity, and the bath level or meniscus in the continuous casting molds is maintained at the desired height. The invention furthermore pertains to a new and improved apparatus for the performance of the aforesaid method.

In the case of multi-strand continuous casting installations an individual strand withdrawal unit or assembly is operatively associated usually with each strand, so that the withdrawal unit can be operated at an individual strand withdrawal speed. In order to maintain the spacing between the cast strands small, there are known to the art withdrawal assemblies or units working with hollow withdrawal rolls. Through these hollow withdrawal rolls there are guided drive shafts for neighboring strands. Such withdrawal units permit the realization of a strand withdrawal speed which is accommodated to each strand, but however are extremely complicated in construction and quite expensive.

Furthermore, it is known in this technology to subdivide plate molds of slab casting installations by means of cooled intermediate walls. By virtue of these measures it is possible to simultaneously cast, at a single-slab casting installation, two narrow slabs or three blooms. Here, it is necessary that the tundish be equipped with appropriately arranged pour nozzles at the base thereof, which, in turn, are equipped with closure elements. The strands which are fabricated in such type of continuous casting installation, by virtue of the construction of the strand guide or roller apron arrangement and the withdrawal unit, are withdrawn from the continuous casting mold with the same speed, and, as a general rule, also commonly cut or separated. The bath level or meniscus of the individual strands is manually maintained at its reference height, or with the aid of bath level-regulation devices by means of stopper or slide controlled pouring nozzles. The simultaneous casting of a number of strands from a plate mold is usually referred to in the art as twin or triple-strand casting.

However, twin castings which have been introduced into practise only have been employed for the fabrication of narrow slabs or blooms. Small sectional shapes, such as billets, have not been fabricated up to the present in twin casting arrangements. On the one hand, difficulties prevail with respect to operational safety, in maintaining the bath level at increased casting speeds at the reference height, and, on the other hand, there are required expensive closure and regulation elements for each strand.

SUMMARY OF THE INVENTION

Therefore, with the foregoing in mind it is a primary object of the present invention to provide a new and improved method and apparatus for continuous casting of a number of strands which is not afflicted with the aforementioned drawbacks and limitations of the prior art proposals.

Another and more specific object of the present invention aims at providing a new and improved method, and apparatus for, simultaneously casting a number of strands with a small spacing of the strands, wherein the cast strands are withdrawn by a common withdrawal unit at the same speed and wherein the equipment operates more simply and with greater operational security.

Yet a further significant object of the present invention aims at providing a new and improved method of, and apparatus for, continuously casting strands, especially strands of small sectional shape and to render the casting process automated by the use of simple means.

It is a further significant object of the present invention to minimize the operating costs for the regulation devices and their maintenance and also the amount of operating and servicing personnel needed for the continuous casting operation.

Now in order to implement these and still further objects of the invention, which will become more readily apparent as the description proceeds, the method of continuous casting a number of strands as contemplated by the invention, is manifested by the features that the withdrawal speed is controlled as a function of a reference infed quantity of metal which flows per unit of time into a first continuous casting mold i.e. the level of molten metal in such first mold, and the infed quantity of metal in at least one further continuous casting mold is regulated as a function of such withdrawal speed i.e the level of molten metal in the further mold.

The teachings of the invention, particularly as concerns the method aspects, relate to a novel control concept for the continuous casting of a number of strands having a small spacing between the strands, wherein maintenance of the bath level height of a first strand is realized by means of the strand withdrawal speed and of at least one further strand by means of a regulation device at the pour nozzle. An inflow regulation for the continuous casting mold of the first strand is therefore not needed. This beneficially affords a reduced operational expenditure in terms of equipping and servicing regulation elements and the operating personnel needed for the continuous casting operation. Additionally, it is also possible to realize with twin pours or castings, maintenance of the bath level height for small strand sectional shapes or formats with high casting speeds.

Not only is the invention concerned with the aforementioned method aspects, but as already alluded to above, also relates to novel apparatus for the performance of such method. According to the invention the apparatus for continuous casting of a number of strands contemplates the provision of a bath level-measuring device for the first continuous casting mold which is electrically connected with a regulation device or apparatus for regulating the speed of the common withdrawal unit or assembly. The bath level-measuring device of the further continuous casting mold is electrically connected with regulation devices for the control of the infed quantity of molten metal.

The pouring nozzle for the first continuous casting mold could be equipped, for instance, with a closure or a throttle device. According to a feature of the invention it is however particularly advantageous if the reference inflow quantity of metal, flowing into the first continuous casting mold, is essentially determined by the shape and dimension of a closureless pouring nozzle opening. When using this casting technique there can be employed as the pouring nozzle for the reference inflow quantity of metal an open pouring nozzle without any regulation device. A certain regulation of the infed quantity of steel can be obtained, if needed, by selection of the height of the bath level in the tundish. Such arrangement enables an appreciable reduction in the use of closure and regulation elements. In the event of malfunction the possibility exists of withdrawing the steel jet by means of an overflow trough or equivalent structure and, in the case of an emergency, the pouring nozzle can be closed by means of a copper stopper by freezing.

Instead of using, for instance stopper or slide closures for the regulation of the casting or teeming jet for the further continuous casting molds, it is possible, according to a further facet of the invention, to advantageously act upon the casting or teeming jet which forms at the pouring nozzle of the tundish, with constricting or bundling electromagnetic fields. Such regulation device for regulating the infed quantity of metal comprises electromagnetic coils which constrict the casting or teeming jet.

As an alternative proposal it is possible, however, to also regulate the casting or teeming jet for the further continuous casting molds, and which casting or teeming jet forms at the pouring nozzle of the tundish, by the action of inflowing gases. The corresponding regulation of the inflow quantity of metal thus encompasses a gas infeed device opening into the pouring outlet nozzle and a related regulation or control.

Both of the aforementioned regulation techniques function without the need to use mechanical power or force applying devices, such as hydraulic cylinder units, and without refractory components, such as stoppers or slide plates. Hence, maintenance of the system is rendered less expensive and there can be prolonged the casting time for each sequence pour due to the absence of any wear at such refractory parts or components. Moreover, for the control of the magnetic field or for the gas quantity there can be used a control which is simpler in relation to the known stopper and slide controls.

If there are selected extremely small strand sectional shapes, then it is advantageous to arrange the first and the further continuous casting molds within a common frame or the like and to couple this frame with an oscillation device. The continuous casting molds then oscillate in synchronism.

As experience has shown clay depositions tend to form at the pouring nozzles and, thus, reduce the size of the open nozzle cross-sectional area after a longer casting duration. In the event of non-regulatable pouring nozzles for the reference inflow quantity, it is advantageous if the throughflow cross-sectional area of such pouring nozzle for the first continuous casting mold is smaller by approximately 10% than the throughflow cross-sectional area of the pouring nozzles for the further or additional continuous casting molds. Malfunctions, which can be caused by irregular clogging of the nozzles for the first or the further continuous casting molds, can be beneficially avoided through the use of these measures.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic side view of a continuous casting installation according to the invention;

FIG. 2 is a fragmentary sectional view through a pouring nozzle equipped with an electromagnetic regulation device; and FIG. 3 is a fragmentary sectional view through a pouring nozzle equipped with a gas infeed device serving as the regulation unit.

DETAILED DESCRIPTION OF THE PREFERRED EMBODIMENTS

Describing now the drawings, it is to be understood that only enough of the construction of the continuous casting installation has been shown to enable those skilled in the art to readily understand the underlying principles and concepts of the present development, while simplifying the illustration and clarity of the drawings. Turning attention now to FIG. 1 there will be seen a tundish 1 having two pouring nozzles 2 and 2' and arranged above two related continuous casting molds 3 and 3', respectively, which are attached in any suitable fashion at a mold frame arrangement 4 or equivalent structure. Each continuous casting mold 3 and 3' is provided with a respective bath level-measuring device 6 and 6', which in the illustrated embodiment may be assumed to be constituted by conventional optical measuring devices. Of course, the invention is in no way confined to optical measuring devices and any other suitable bath level-measuring devices can be beneficially employed. Arranged following each continuous casting mold 3 and 3' is a conventional secondary cooling zone 8 and thereafter there is provided a common strand withdrawal unit or assembly 10 for withdrawing both of the continuously cast strands 9 and 9'.

The bath level-measuring device 6 of the first continuous casting mold 3 is electrically connected with a control device or control means 11 for controlling the withdrawal speed of the withdrawal unit 10. In the event of too great infeed of casting metal by the pouring nozzle 2, the control means 11 automatically increases the withdrawal speed of both of the continuously cast strands 9 and 9' and vice versa. The bath level-measuring device 6' of the second continuous casting mold 3' or further continuous casting molds which may be arranged in the mold frame arrangement 4, is electrically connected with a control 13 for controlling the quantity of infed metal from the pouring nozzle 2'. Controls suitable for this purpose are well-known in the art, as exemplified by U.S. Pat. No. 2,743,492, granted May 1, 1956.

The control device or control means 13 is connected with electromagnetic coils 15, which cause constricting electromagnetic fields to act upon the formed casting or teeming jet for the continuous casting mold 3'. Due to this constricting or bundling effect there can be regulated the metal throughflow quantity.

The inventive method has a prerequisite thereof that, both of the strands 9 and 9' are withdrawn at the same speed or velocity, i.e. are withdrawn from the continuous casting molds 3 and 3' by means of a single withdrawal unit or assembly 10. The withdrawal speed is thus controlled as a function of the reference infed quantity of metal which flows per unit of time into the first continuous casting mold 3 i.e. also the level of molten metal in such first mold, and the infed quantity to the further continuous casting mold 3' is regulated as a function of the withdrawal speed i.e. also, in turn, as a function of the level of the molten metal in the further mold, by means of the bath level-measuring device 6', the control means 13 and the electromagnetic coils 15. The reference infed quantity of metal which flows into the first continuous casting mold 3, essentially is only governed by the shape and dimensions of the closureless pouring nozzle 2. Instead of using one further or additional continuous casting mold 3' it is to be understood that still further continuous casting molds can be employed.

The throughflow cross-sectional area of the pouring nozzle 2 for the reference inflow quantity to the first continuous casting mold 3, advantageously is selected to be approximately 10% smaller than the throughflow cross-sectional area of the pouring nozzle 2' for the further continuous casting mold 3'.

The first continuous casting mold 3 and the further continuous casting mold 3' are connected, by means of the mold frame arrangement or frame means 4, with a conventional mold oscillation device 17. Hence, both of the continuous casting molds 3 and 3' oscillate in synchronism.

In order to facilitate the start of the pouring or teeming operation at such continuous casting installation, it is advantageous if the bath level-measuring devices in the molds are capable of measuring an extremely large height or elevational range and if devices are provided which can measure and compare, during the start of the casting operation, the ascent speed or velocity of the bath level in both of the continuous casting molds 3 and 3'. By means of a generated comparison signal which can be obtained in this way, it is possible to detect at an incipient stage different inflow quantities and to control the electromagnetic coils 15 prior to reaching the reference bath level or height, in order to thereby render possible disturbance-free starting of the casting operation, even when casting small sectional shapes.

Turning attention now to FIG. 2, there is shown a pouring nozzle 2 of a tundish 1 which, in this case, is provided with a throttle device in the form of an electromagnetic coil 21. The electromagnetic coil or coil means 21 produces a magnetic field having a force which has an effective direction 22 acting against the casting or teeming jet. As a function of the current intensity which prevails at the electromagnetic coil 21 it is possible to alter the magnetic field, and thus, the metal outflow quantity from the nozzle 2. The throttling action attained by means of the action of the electromagnetic coil 21, considered with respect to the maximum throughflow quantity, is only effective throughout a certain range. In order to close the nozzle it is possible to use a copper stopper in the case of an emergency.

Now in FIG. 3 there is illustrated a pouring nozzle 31 of a tundish 1. Here, the pouring nozzle 31 is equipped with a throttle device 32, 33 for the gas quantity, this throttle device comprising a gas infeed means or line 32 and a control device or control 33. The control 33, in turn, is connected with the related bath level-measuring device, such as, by way of example, of the type disclosed during the discussion of the arrangement of FIG. 1. Due to the action of the gas which is forced in, typically a suitable inert gas as is conventionally used in the continuous casting art, it is intended to disturb or affect the inflow stream of metal to the infeed funnel 40 of the pouring nozzle 31, in order to obtain throttling of the infed quantity of metal.

Instead of using the described throttling devices, it is to be understood that it is also possible to use other throttling devices.

The oscillation movement imparted to the continuous casting molds can be replaced, for instance, by a vibration motion or through the use of ultrasonic energy.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. In a method for the continuous casting of a number of strands, wherein steel from at least one tundish is cast into continuous casting molds, the thus formed strands are withdrawn from the continuous casting molds at the same speed, cooled and the levels of molten steel in the continuous casting molds are maintained at desired heights, the improvement which comprises the steps of:

controlling the withdrawal speed in a first of said continuous casting molds as a function of the level of molten steel in said first continuous casting mold;

measuring the level of molten steel in each of the other molds; and regulating the quantity of infed steel flowing into each of said other molds as a function of the level of molten steel in each respective other mold.

2. The method as defined in claim 1, further including the step of:

determining a reference infed quantity of steel flowing into the first continuous casting mold essentially by the shape and dimension of a closureless pouring nozzle opening of the tundish.

3. The method as defined in claim 1, wherein:

the step of regulating the quantity of infed steel flowing into each of the other molds comprises generating electromagnetic fields which have a constricting action upon a casting jet of each of the other continuous casting molds and which is formed at a pouring nozzle of the tundish.

4. The method as defined in claim 1, wherein:

the step of regulating the quantity of infed steel flowing into each of the other continuous casting molds is accomplished by the action of an inflowing gas which acts upon a casting jet forming at a pouring nozzle of the tundish.

5. The method a defined in claim 1, further including the step of:

oscillating the first and each of the other molds in synchronism.

6. A method of continuous casting a number of strands, comprising the steps of:

providing at least a first continuous casting mold and a second continuous casting mold;

casting molten metal from at least one tundish into said first and second continuous casting molds in order to form therein continuously cast strands;

withdrawing the continuously cast strands from the continuous casting molds at the same speed;

controlling the withdrawal speed of the continuously cast strand at the first continuous casting mold as a function of the level of molten metal in the first continuous casting mold;

measuring the level of molten metal in the second continuous casting mold; and regulating the quantity of infed molten metal to the second continuous casting mold as a function of the level of molten metal in the second continuous casting mold.

7. The method as defined in claim 6, further including the step of:

controlling a reference infed quantity of molten metal flowing into the first continuous casting mold essentially by the shape and dimensions of a closureless pouring nozzle opening of the tundish.

8. The method as defined in claim 6, wherein:

the step of regulating the quantity of infed molten metal to the second continuous casting mold is accomplished by producing electromagnetic fields effective at the second continuous casting mold for acting upon a teeming jet of molten metal which forms at a pouring nozzle of the tundish and having a constricting effect upon such teeming jet.

9. The method as defined in claim 6 wherein:

the step of regulating the quantity of infed molten metal to the second continuous casting mold comprises regulating a teeming jet of the second continuous casting mold and which forms at a pouring nozzle of the tundish by infeeding a gas.

10. An apparatus for continuously casting a number of strands comprising:

at least one tundish having at least two pouring nozzles;

at least two continuous casting molds;

said two pouring nozzles being respectively arranged above related ones of said at least two continuous casting molds;

bath level-measuring means operatively associated with said continuous casting molds;

secondary cooling means for cooling the continuously cast strands formed in and emanating from the continuous casting molds;

common strand withdrawal means arranged following the secondary cooling means;

said at least two continuous casting molds defining a first continuous casting mold and a second continuous casting mold;

said bath level-measuring means comprising a bath level-measuring device provided for the first continuous casting mold;

control means for controlling the speed of the common strand withdrawal means and with which there is electrically connected said bath level-measuring device;

said bath level-measuring means comprising a further bath level-measuring device provided for the second continuous casting mold; and regulation means for regulating the infed quantity of molten metal with which there is electrically connected the bath level-measuring device of the second continuous casting mold.

11. The apparatus as defined in claim 10, wherein: said regulation means for the regulation of the infed quantity of molten metal comprises electromagnetic coil means which constrict the casting jet.

12. The apparatus as defined in claim 10, wherein:

said regulation means for the infed quantity of molten metal comprises a gas infeed device opening into a predetermined pouring nozzle of said tundish and control means for controlling the gas quantity.

13. The apparatus as defined in claim 10, wherein:

one of the pouring nozzles serves for the infeed of a reference infed quantity of molten metal to the first continuous casting mold; and said one pouring nozzle having a throughflow cross-sectional area which is approximately 10% smaller than the throughflow cross-sectional area of the pouring nozzle for the second continuous casting mold.

14. The apparatus as defined in claim 10, further including:

common mold frame means for mounting said first and second continuous casting molds; and mold oscillation means operatively associated with said mold frame means.

* * * * *